US008186428B2

(12) United States Patent
Coronado et al.

(10) Patent No.: US 8,186,428 B2
(45) Date of Patent: May 29, 2012

(54) FIBER SUPPORT ARRANGEMENT FOR A DOWNHOLE TOOL AND METHOD

(75) Inventors: Martin P. Coronado, Cypress, TX (US); Stephen L. Crow, Kingwood, TX (US); Vinay Varma, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 402 days.

(21) Appl. No.: 11/732,159

(22) Filed: Apr. 3, 2007

(65) Prior Publication Data

US 2008/0245533 A1 Oct. 9, 2008

(51) Int. Cl.
*E03B 3/18* (2006.01)
*E21B 47/12* (2006.01)

(52) U.S. Cl. ..... 166/227; 166/250.01

(58) Field of Classification Search ..... 166/227–236, 166/250.01, 113, 66; 73/800; 385/12, 13; 250/227.14, 227.17

See application file for complete search history.

(56) References Cited

U.S. PATENT DOCUMENTS

| | | | | |
|---|---|---|---|---|
| 3,788,304 | A * | 1/1974 | Takahashi | 600/141 |
| 4,775,009 | A * | 10/1988 | Wittrisch et al. | 166/250.11 |
| 4,927,232 | A * | 5/1990 | Griffiths | 385/13 |
| 5,767,411 | A * | 6/1998 | Maron | 73/705 |
| 5,892,860 | A * | 4/1999 | Maron et al. | 385/12 |
| 6,233,374 | B1 * | 5/2001 | Ogle et al. | 385/13 |
| 6,278,811 | B1 * | 8/2001 | Hay et al. | 385/13 |
| 6,374,913 | B1 * | 4/2002 | Robbins et al. | 166/66 |
| 6,409,219 | B1 * | 6/2002 | Broome et al. | 285/3 |
| 6,554,064 | B1 * | 4/2003 | Restarick et al. | 166/250.01 |
| 6,563,970 | B1 * | 5/2003 | Bohnert et al. | 385/13 |
| 6,614,723 | B2 * | 9/2003 | Pearce et al. | 367/154 |
| 6,896,049 | B2 | 5/2005 | Moyes | 166/82.1 |
| 7,003,184 | B2 * | 2/2006 | Ronnekleiv et al. | 385/12 |
| 7,071,696 | B2 * | 7/2006 | Gambier et al. | 324/347 |
| 7,245,791 | B2 * | 7/2007 | Rambow et al. | 385/12 |
| 7,315,666 | B2 * | 1/2008 | Van Der Spek | 385/12 |
| 7,398,697 | B2 * | 7/2008 | Allen et al. | 73/800 |
| 7,512,292 | B2 * | 3/2009 | MacDougall et al. | 385/12 |
| 7,735,555 | B2 * | 6/2010 | Patel et al. | 166/278 |

(Continued)

FOREIGN PATENT DOCUMENTS

GB 2408527 A 6/2005

OTHER PUBLICATIONS

Restarick, Henry; "Horizontal Completion Options in Reservoirs With Sand Problems"; SPE29831; SPE Middle East Oil Show, Bahrain; Mar. 11-14, 1995; pp. 545-560.

PCT Search Report and Written Opinion PCT/US2008/058417; Mailed Aug. 21, 2008; International Search Report 6 pages and Written Opinion 7 pages.

Ren L et al., "Application of Tube-Packaged FBG Strain Sensor in Vibration Experiment of Submarine Pipeline Model" China Ocean Engineering, Haiyang Chubanshe, Bejing, CN, vol. 20, No. 1, Jan. 1, 2006, pp. 155-164.

*Primary Examiner* — Kenneth Thompson

(74) *Attorney, Agent, or Firm* — Cantor Colburn LLP

(57) ABSTRACT

A fiber support arrangement for a downhole tool includes a tubular; at least one end ring positioning the tubular spaced radially from a downhole tool and lacking contact therewith; and a fiber supported at the tubular and method.

23 Claims, 2 Drawing Sheets

U.S. PATENT DOCUMENTS

2002/0007948 A1 1/2002 Bayne et al.
2002/0088744 A1 7/2002 Echols et al.
2004/0035578 A1* 2/2004 Ross et al. ..... 166/250.15
2004/0173350 A1* 9/2004 Wetzel et al. ..... 166/253.1
2004/0262011 A1* 12/2004 Huckabee et al. ..... 166/369
2005/0092485 A1* 5/2005 Brezinski et al. ..... 166/207
2006/0048950 A1* 3/2006 Dybevik et al. ..... 166/387
2006/0115203 A1* 6/2006 Wait et al. ..... 385/12
2007/0204465 A1* 9/2007 Huang et al. ..... 29/896.6
2007/0237467 A1* 10/2007 Rubinstein et al. ..... 385/99

* cited by examiner

FIBER SUPPORT ARRANGEMENT FOR A DOWNHOLE TOOL AND METHOD

BACKGROUND OF THE INVENTION

The oil and gas recovery industry in recent years has increasingly discovered uses for optical fiber in signal conductance and sensory applications for the downhole environment. In view of the harshness of that environment, the delicate optical fibers must be protected yet disposed optimally to sense desired parameters to conduct signals to desired end devices.

In a sensory capacity, the fiber must be exposed to the parameter being measured to be able to register that parameter, strain as a parameter presents a particular difficulty because of the need for the fiber to be protected but also to be exposed to the strain in the environment being sensed. Solutions to the foregoing are well received by and beneficial to the art.

SUMMARY

A fiber support arrangement for a downhole tool includes a tubular; at least one end ring positioning the tubular spaced radially from a downhole tool and lacking contact therewith; and a fiber supported at the tubular.

A method for supporting a fiber at a downhole tool includes disposing an outer support at a downhole tool, the support being radially outwardly positioned of the tool; supporting the support to a string axially spaced from each end of the downhole tool such that the downhole tool is lacking contact with the support; and mounting a fiber at the support such that the fiber is lacking contact with the downhole tool.

BRIEF DESCRIPTION OF THE DRAWINGS

Referring now to the drawings wherein like elements are numbered alike in the several Figures.

DETAILED DESCRIPTION OF THE DRAWINGS

Figure 1:
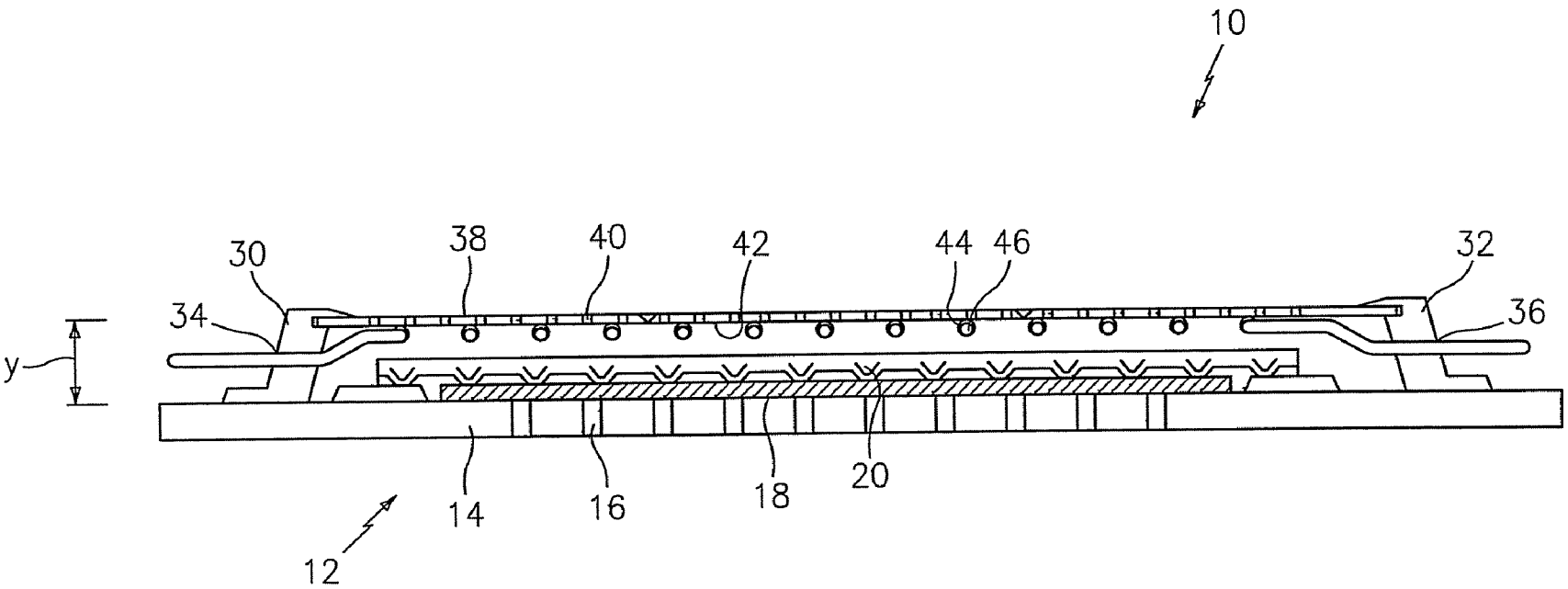
FIG. 1 is a schematic cross-section view of an embodiment of a fiber support for a downhole tool.

Referring to FIG. 1, a fiber support arrangement for a downhole tool is illustrated at 10. In the FIG. 1 embodiment, the fiber support arrangement 10 is illustrated at a sand screen assembly 12 comprising a base pipe 14 having holes 16, a filter media 18 and a shroud 20. The sand screen assembly 12 as illustrated is similar to a commercially available product from Baker Oil Tools, Houston, Tex. under product number H48690, and as such does not require detailed further explanation but rather has been identified merely for environment and to provide an understanding of relative positioning.

The fiber support arrangement 10 comprises at least one end ring and as illustrated two end rings 30 and 32 each having a fiber pass through 34 and 36, respectively and which may be sized to allow pass through of the fiber alone or the fiber inside of a conduit. End rings 30 and 32 have a radial dimension y sufficient to ensure a clearance between the sand screen assembly 12 (or other downhole tool) and a fully assembled fiber support arrangement 10 such that contact between the fiber support arrangement and the sand screen assembly (or other downhole tool) does not occur. The end rings may be fully annular structures or may be segmented as desired.

Extending from one end ring 30 to the other end ring 32 is a perforated tubular 38, which may be a metal tubular), the perforations being identified with the numeral 40. At an inside dimension surface 42 of the tubular 38 is a fiber conduit 44, which in one embodiment is strain transmissively disposed thereat. It is to be understood that in other embodiments, the fiber conduit is disposed to facilitate the fiber therein measuring or sensing temperature, seismic, pressure, chemical composition, etc. The conduit 44 may be a metal tube such as a quarter inch or eighth inch or sixteenth inch stainless steel tubular, for example. In one embodiment, the conduit 44 is welded by, for example, an induction welding technique to the inside surface 42 of tubular 38. In another embodiment, the fiber conduit is mechanically or adhesively attached to surface 42 (it is to be understood that adhesive processes are intended to include soldering and brazing processes). Broadly stated, any means of attachment of the fiber conduit 44 to the tubular 38 that allows for, in one embodiment, transmission of strain in the tubular 38 to the fiber conduit 44 without significant loss of magnitude or at least a reliably predictable loss in magnitude or in other embodiments facilitating or at least not hindering the measurement or sensing of such properties as seismic, temperature, pressure, chemical composition, etc. is sufficient for purposes of the invention disclosed herein. It is to be understood that combinations of sensitivities are also contemplated wherein one or more of the exemplary properties are sensed or combinations including at least one of the exemplary properties are sensed.

In order to ensure optimal function of a fiber 46 installed in the fiber conduit 44, consideration must be given to the means of attachment of the fiber conduit to the tubular 38. This is particularly true if a welding process or other heat intensive process is to be used for the affixation of the fiber conduit 44 to the tubular 38. Depending upon the heat to be applied and the resistance to heat damage a particular type of optical fiber 46 exhibits, it is possible to place the fiber in the conduit 44 before welding (or other heat process) or alternatively creates a requirement to place the fiber 46 in the conduit 44 after welding (or other heat process).

Regardless of process of attachment, the fiber 46 (either before or after conduit attachment) is installed in the conduit 44, the conduit or the fiber being adapted to allow the fiber to sense the target property. In one embodiment the fiber is embedded in a strain transmissive potting substance such as for example, epoxy inside the conduit 44. Such substance ensures that strain in the conduit 44, transmitted thereto by the tubular 38, is in turn transmitted to the fiber 46 where it will effect a frequency shift in the transmission wavelength of the fiber thus indicating at a remote location a strain and its magnitude.

In one embodiment of the support, a strip of perforated material is helically wound about an axis and welded at sides thereof to create the tubular form. This method is known to the art but pointed out here for the purpose of noting that the conduit 44 maybe strain transmissively or otherwise disposed at the strip before the strip is helically wound, as the strip is helically wound or after the strip is helically wound, as desired. In the event the conduit is to be placed after the strip is wound i.e. after tubular 38 is formed, then it is desirable to helically wind the conduit 44 first and install it in the tubular 38 as a helical coil prior to strain transmissive disposition thereof.

The completed tubular 38 and conduit 44 are disposed between the end rings 30 and 32 and secured there permanently. The conduit 44, as shown extends beyond the end rings 30 and 32 through pass throughs 34 and 36, respectively, and then to connectors (not shown).

As is illustrated, the conduit 44 is spaced from the sand screen assembly shroud 20 so as to make no contact therewith when installed. As is illustrated, the fiber support arrangement is attached to the base pipe 14 axially outside of the attachment points of the screen filter media 18 and shroud 20 and may be at the ends of such base pipe 14, if desired. As one of skill in the art will anticipate, one means of attachment of the end rings 30 and 32 to the base pipe 14 is by welding as shown.

While the embodiment illustrated in FIG. 1, supports the conduit 44 on the inside surface 42 of the tubular 38 it should be noted that it could also be supported on the outside surface of the tubular 38 if circumstances so dictate though consideration should then be given to an increased risk of mechanically induced damage to the conduit 44 in such position, especially while running.

Figure 2B:
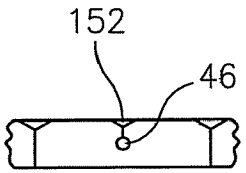
FIG. 2B is an enlarged detail view of circumscribed area 2-2 in FIG. 2 after being closed.
Figure 2A:
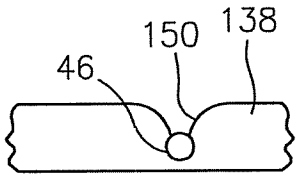
FIG. 2A is an enlarged detail view of circumscribed area 2-2 in FIG. 2 prior to being closed.
Figure 2:
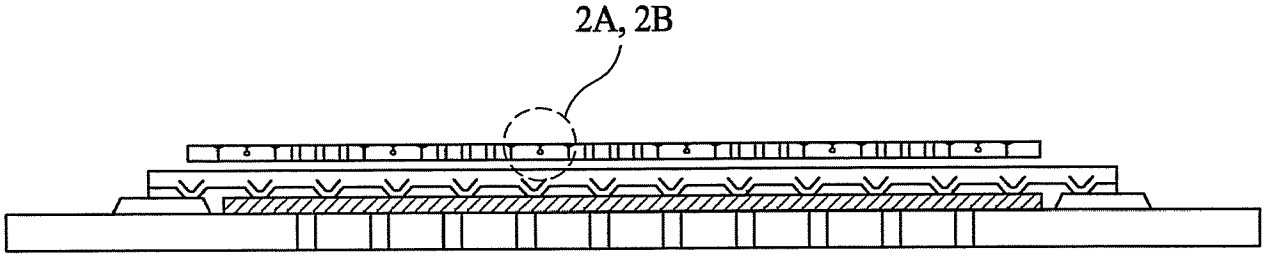
FIG. 2 is a schematic cross-section view of another embodiment of a fiber support for a downhole tool.

In another embodiment, referring to FIG. 2, most of the components are the same and are therefore not described or in some cases illustrated. What is distinct is a tubular 138, which is analogous to tubular 38 with regard to positioning and support. Tubular 138, instead of supporting a separate fiber conduit 44, creates a conduit 144 (144 not shown in figure) for optic fiber 46. In this embodiment, the material, which may be metal, of tubular 138 is split about half way through the thickness thereof. Detail illustrations in FIGS. 2A and 2B will enhance understanding hereof. In FIG. 2A, the material of tubular 138 is illustrated with a cleft 150 open for insertion of fiber 46 (shown inserted), which may be configured to sense temperature, pressure, seismic, chemical composition and may in one embodiment include a strain transmissive potting material such as epoxy around the fiber 46. FIG. 2B illustrates the cleft 150 closed and permanently fused by a process such as welding or adhesive or mechanical process as appropriate. In FIG. 2B, the process illustrated is welding at weld bead 152.

In other respects, the FIG. 2 embodiment is similar to the FIG. 1 embodiment including creation of tubular 138 from a strip. In its final assembled position, tubular 138 is again spaced from the sand screen assembly 12 as is tubular 38.

Figure 3:
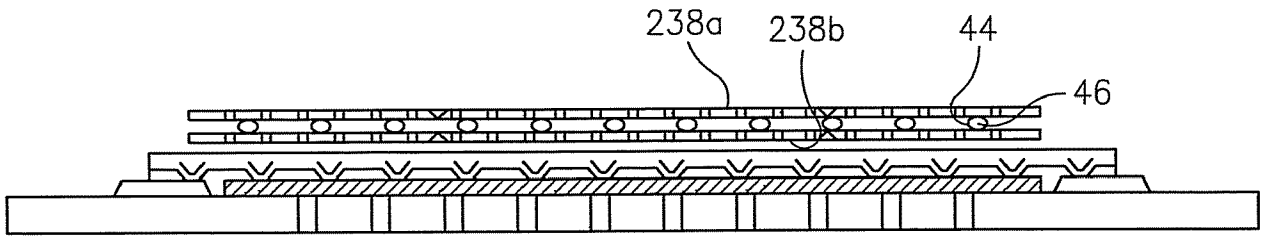
FIG. 3 is a schematic cross-section view of another embodiment of a fiber support for a downhole tool.

Finally, and referring to FIG. 3, a tubular 238 is created having two distinct nested layers 238*a* and 238*b*. A fiber conduit 44 similar to that described with regard to FIG. 1 is sandwiched between the layers 238*a* and 238*b* prior to a swaging process applied to the two layers to strain transmissively position the conduit 44 permanently between the layers 238*a* and 238*b* thereby forming a complete tubular 238. It is to be noted that other interfering fit processes could be substituted for swaging if desired with the ultimate goal being to ensure that the two tubular layers are made to intervere with one another sufficiently to strain transmissively retain the fiber conduit therebetween, if the embodiment calls for strain measurement, or sufficiently exposed for measuring one of the other parameters disclosed hereinabove. As illustrated in FIG. 3, tubular 238 is spaced from the screen filter media 18 and shroud 20 so as not to make contact therewith and is supported in the illustrated position as is the tubular 38 of FIG. 1. As in the foregoing embodiments, this tubular may start as a strip of material for each of tubular 238*a* and 238*b*.

While preferred embodiments have been shown and described, modifications and substitutions may be made thereto without departing from the spirit and scope of the invention. Accordingly, it is to be understood that the present invention has been described by way of illustrations and not limitation.

The invention claimed is:

1. A fiber support arrangement for a downhole sand screen comprising:

a tubular;

at least one end ring positioning the tubular spaced radially from the downhole sand screen the tubular lacking contact with the downhole sand screen; and a fiber supported at the tubular, the tubular including a fiber conduit strain transmissively mounted to the tubular and enveloping the fiber.

2. A fiber support arrangement as claimed in claim 1 wherein the fiber is strain transmissively mounted at the tubular.

3. A fiber support arrangement as claimed in claim 1 wherein the conduit contains between an inside dimension thereof and an outside dimension of the fiber a strain transmissive potting material.

4. A fiber support arrangement as claimed in claim 3 wherein the potting material is epoxy.

5. A fiber support arrangement as claimed in claim 1 wherein the at least one end ring is two end rings.

6. A fiber support arrangement as claimed in claim 1 wherein the at least one end ring includes a pass through for the fiber.

7. A fiber support arrangement as claimed in claim 6 wherein the pass through is sized to pass a conduit and fiber.

8. A fiber support arrangement as claimed in claim 1 wherein the fiber is an optic fiber.

9. A fiber support arrangement as claimed in claim 1 wherein the at least one end ring is fixedly attached to a base pipe axially beyond the downhole sand screen.

10. A fiber support arrangement as claimed in claim 1 wherein the fiber conduit is mounted by welding.

11. A fiber support arrangement as claimed in claim 1 wherein the fiber conduit is mounted by mechanical attachment.

12. A fiber support arrangement as claimed in claim 1 wherein the fiber conduit is mounted by adhesive attachment.

13. A fiber support arrangement as claimed in claim 1 wherein the fiber conduit is mounted at an inside surface of the tubular.

14. A fiber support arrangement as claimed in claim 1 wherein the fiber conduit is mounted at an outside surface of the tubular.

15. A fiber support arrangement as claimed in claim 1 wherein the tubular houses the fiber within a cleft created therein, the cleft being closed after insertion of the fiber.

16. A fiber support arrangement as claimed in claim 15 wherein the cleft is an opening in a material of the tubular, the opening extending about half way through a thickness of the material of the tubular.

17. A fiber support arrangement as claimed in claim 15 wherein the cleft further contains a strain transmissive potting material.

18. A fiber support arrangement as claimed in claim 17 wherein the potting material is epoxy.

19. A fiber support arrangement as claimed in claim 15 wherein the cleft is closed by welding.

20. A fiber support arrangement as claimed in claim 15 wherein the cleft is closed by adhesive affixation.

21. A fiber support arrangement as claimed in claim 1 wherein the fiber is disposed within a conduit and the conduit is sandwiched between two layers of the tubular.

22. A fiber support arrangement as claimed in claim 21 wherein the two layers of the tubular are swaged together.

23. A fiber support arrangement as claimed in claim 1 wherein the fiber is sensitive to at least one of strain, temperature, pressure, chemical composition, seismic and combinations including at least one of the foregoing.

* * * * *